US011421174B2

(12) United States Patent
Parmar et al.

(10) Patent No.: US 11,421,174 B2
(45) Date of Patent: Aug. 23, 2022

(54) HINDERED AMINE TERMINATED SUCCINIMIDE DISPERSANTS AND LUBRICATING COMPOSITIONS CONTAINING SAME

(71) Applicant: The Lubrizol Corporation, Wickliffe, OH (US)

(72) Inventors: Dixit Parmar, Long Eaton (GB); Joanne L. Jones, Nottingham (GB); Daniel J. Saccomando, Sheffield (GB); Nicolas Proust, Painesville, OH (US); Patrick E. Mosier, Berea, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 16/768,252

(22) PCT Filed: Nov. 29, 2018

(86) PCT No.: PCT/US2018/062949
§ 371 (c)(1),
(2) Date: May 29, 2020

(87) PCT Pub. No.: WO2019/108723
PCT Pub. Date: Jun. 6, 2019

(65) Prior Publication Data

US 2020/0369974 A1 Nov. 26, 2020

Related U.S. Application Data

(60) Provisional application No. 62/592,706, filed on Nov. 30, 2017.

(51) Int. Cl.

| | |
|---|---|
| ***C10M 133/56*** | (2006.01) |
| ***C10N 30/00*** | (2006.01) |
| ***C10N 30/04*** | (2006.01) |
| ***C10N 30/12*** | (2006.01) |
| ***C10N 40/25*** | (2006.01) |

(52) U.S. Cl.
CPC .... *C10M 133/56* (2013.01); *C10M 2215/064* (2013.01); *C10N 2030/04* (2013.01); *C10N 2030/12* (2013.01); *C10N 2030/36* (2020.05); *C10N 2040/25* (2013.01)

(58) Field of Classification Search
CPC ..... C10M 2205/04; C10M 2219/046; C10M 2223/045; C10M 2205/06; C10M 133/56; C10M 2207/023; C10M 2215/064; C10N 2030/04; C10N 2210/02; C10N 2030/12; C10N 2030/36; C10N 2040/25; C10N 2230/04; C10N 2230/12; C10N 2230/36; C10N 2240/10
See application file for complete search history.

(56) References Cited

U.S. PATENT DOCUMENTS

| | | | | |
|---|---|---|---|---|
| 3,280,033 | A | 10/1966 | Drummond | |
| 5,235,067 | A * | 8/1993 | Allen | C07D 207/412 508/291 |
| 2003/0171225 | A1* | 9/2003 | Stachew | C10M 133/56 508/291 |

FOREIGN PATENT DOCUMENTS

| | | | | |
|---|---|---|---|---|
| EP | 0451380 | A1 | 10/1991 | |
| WO | 2012/154708 | A1 | 11/2012 | |
| WO | WO-2012154708 | A1 * | 11/2012 | C10M 133/44 |

* cited by examiner

*Primary Examiner* — Latosha Hines
(74) *Attorney, Agent, or Firm* — Thoburn T. Dunlap

(57) ABSTRACT

The disclosed technology relates to a dispersant composition comprising the reaction product of a polyolefin acylating agent and a polyamine having a sterically hindered head group. In addition, the technology relates to lubricating compositions containing the dispersant composition and an oil of lubricating viscosity, as well as methods of employing the lubricating composition in an engine and engine oils. Lubricating oils containing the dispersants of the disclosed technology simultaneously achieves seal compatibility, wear, deposit, varnish and corrosion control while also maintaining fuel economy performance over a broad temperature range.

12 Claims, No Drawings

HINDERED AMINE TERMINATED SUCCINIMIDE DISPERSANTS AND LUBRICATING COMPOSITIONS CONTAINING SAME

CROSS REFERENCE TO RELATED APPLICATION

This application claims priority from PCT Application Serial No. PCT/US2018/062949 filed on Nov. 29, 2018, which claims the benefit of U.S. Provisional Application No. 62/592,706 filed on Nov. 30, 2017, both of which are incorporated in their entirety by reference herein.

FIELD OF THE TECHNOLOGY

The disclosed technology relates to a dispersant composition for lubricating oils obtained by reacting a polyolefin acylating agent with a polyamine terminated with at least one sterically hindered amine moiety. More particularly, the technology relates to a lubricating oil dispersant having improved compatibility towards fluorocarbon elastomeric seals, as well as to methods of employing the dispersant composition in engine oils and in engines

BACKGROUND

Lubricating oil compositions used to lubricate internal combustion engines contain a major portion of a base oil of lubricating viscosity and a variety of lubricating oil additives to improve the performance of the oil. Lubricating oil additives are used to improve detergency, reduce engine wear, provide stability against heat and oxidation, inhibit corrosion, and increase engine efficiencies by reducing friction. It is known to employ nitrogen containing dispersants in the formulation of crankcase lubricating oil compositions. These dispersants contribute to engine cleanliness by keeping soot and other particulate breakdown products in suspension and thus preventing them from depositing onto internal engine surfaces. The most widely used dispersants for this purpose are the alkenyl substituted succinimides which are prepared by reacting an alkenyl substituted succinic anhydride with a polyamine.

Succinimide dispersants have a relatively high basic nitrogen content expressed as total base number (TBN, ASTM D2896). Generally, higher nitrogen content gives better dispersancy and deposit control. The challenge, however, is to deliver higher TBN without harming seals compatibility, particularly for Viton® fluorocarbon elastomeric seals, which is often problematic when basic nitrogen compounds are added to a lubricating oil. One contribution to fluoropolymer seals degradation arises from the attack of the fluoropolymer by amine containing succinimide dispersants. Amines are believed to cause dehydrofluorination of the fluoropolymer backbone. The resulting unsaturation that forms is susceptible to oxidation, leading to a loss of physical properties, seals degradation and ultimate failure.

Seals failure impairs engine performance, increases the potential for engine damage, and leads to environmentally unacceptable oil seepage from the crankcase. In addition to seals incompatibility, some succinimide dispersants deleteriously affect copper and lead corrosion in engine oil formulations.

There is a need for a dispersant that delivers TBN to a lubricant oil without the concomitant detrimental effects to seals compatibility and corrosion. Particularly, there is need for basic amine containing succinimide dispersants that deliver a balance of TBN to an engine oil, mitigates the deleterious effects of soot, varnish and sludge and which are compatible with engine seals.

An additional challenge facing lubricant oil formulations is low temperature viscosity. When cold, particularly during the winter months in temperate regions of the world, lubricant oils are viscous requiring more energy to circulate until normal engine operating temperatures are reached. Cold starting an engine on a frigid winter day requires the crankshaft to rotate through viscous oil until the engine starts and the oil reaches normal operating temperatures and viscosities. This places a higher workload on the engine necessitating more fuel utilization until normal operating temperatures and viscosities are reached. Additionally, engine components are vulnerable to wear until the oil warms enough to flow efficiently throughout the engine.

Therefore, a major challenge in engine oil formulation is simultaneously achieving seal compatibility, wear, deposit, varnish and corrosion control while also maintaining fuel economy performance over a broad temperature range.

The present inventors have discovered that the addition of a dispersant composition comprising the reaction product of a polyolefin acylating agent and a polyamine terminated with at least one sterically hindered amine moiety boosts the TBN level of a lubricant oil without harming fluoropolymer seal compatibility while minimizing impact on low temperature viscosity, in addition to contributing to engine cleanliness by suspending and dispersing lubricant contaminants to keep key engine component surfaces free of varnish, sludge and soot deposits, as well as corrosive degradation products.

SUMMARY OF THE DISCLOSED TECHNOLOGY

In one aspect, the present technology concerns a dispersant additive suitable for reducing engine deposits and which is compatible with fluorocarbon elastomeric seals of an internal combustion engine.

In a related aspect, the present technology is directed to a lubricating composition containing a major amount of an oil of lubricating viscosity and a minor effective dispersing amount of a succinimide dispersant suitable for reducing engine deposits and the degradation of elastomeric seals in which the nitrogen containing moiety(ies) of the dispersant are compatible with the fluorocarbon elastomeric seals of an internal combustion engine.

In a related aspect, the present technology concerns a lubricating composition that provides a balance between deposit control and seals compatibility.

In a related aspect, the present technology provides a lubricating oil composition that meets the increasingly stringent standards for engine lubricant seals compatibility test performance specifications of ASTM, DIN, ISO, CEC and other local standards.

In a related aspect, the present technology provides a method for improving the wear life and other tribological properties of an internal combustion engine by adding a dispersing amount of a succinimide dispersant which is the reaction product of:

i) a hydrocarbyl substituted acylating agent wherein the hydrocarbyl substituent has a molecular weight of 1200 or less; and ii) at least one polyamine containing at least one sterically hindered amine moiety.

In a related aspect, the present technology provides a lubricating oil composition suitable for reducing engine deposits and corrosion while increasing TBN and prevents or mitigates the degradation of elastomer seals in an internal combustion engine, said composition comprising:

a) an oil of lubricating viscosity and b) a succinimide dispersant which is the reaction product of:

i) a hydrocarbyl substituted acylating agent wherein the hydrocarbyl substituent has a molecular weight of about 1000 or less; and ii) at least one polyamine containing at least one sterically hindered amine moiety.

In another related aspect, the present technology is directed to the use of a succinimide dispersant to improve the seals compatibility of a lubricating oil in an internal combustion engine wherein said dispersant is obtained by the reaction product of:

i) a hydrocarbyl substituted acylating agent wherein the hydrocarbyl substituent has a molecular weight of about 1200 or less; and ii) at least one polyamine containing at least one sterically hindered amine moiety.

In another related aspect, the improved seals compatibility of the dispersant of the present technology facilitates the use of higher amounts of dispersant as well as other amine containing engine oil additives without the associated problem of engine seals degradation.

DETAILED DISCLOSURE

Aspects according to the present technology are described hereinafter. Various modifications, adaptations or variations of such exemplary aspects described herein may become apparent to those skilled in the art as such are disclosed. It will be understood that all such modifications, adaptations or variations that rely on the teachings of the present technology, and through which these teachings have been advanced in the art, are considered to be within the scope and spirit of the present technology.

As discussed previously, the disclosed technology provides a lubricating oil composition comprising:

a) an oil of lubricating viscosity; and b) a succinimide dispersant which is the reaction product of:

i) a hydrocarbyl substituted acylating agent wherein the hydrocarbyl substituent has a molecular weight of about 1200 or less; and ii) at least one polyamine containing at least one sterically hindered amine moiety.

Oil of Lubricating Viscosity

The oils of lubricating viscosity of can include, for example, natural and synthetic oils, oil derived from hydrocracking, hydrogenation, and hydrofinishing, unrefined, refined and re-refined oils and mixtures thereof. Oils of lubricating viscosity may also be defined as specified in the American Petroleum Institute (API) Base Oil Interchangeability Guidelines.

Unrefined oils are those obtained directly from a natural or synthetic source generally without (or with little) further purification treatment. Refined oils are similar to the unrefined oils except they have been further treated in one or more purification steps to improve one or more properties. Purification techniques are known in the art and include solvent extraction, secondary distillation, acid or base extraction, filtration, percolation and the like. Re-refined oils are also known as reclaimed or reprocessed oils and are obtained by processes similar to those used to obtain refined oils and often are additionally processed by techniques directed to removal of spent additives and oil breakdown products. Natural oils useful in making the inventive lubricants include animal oils, vegetable oils (e.g., castor oil), mineral lubricating oils such as liquid petroleum oils and solvent-treated or acid-treated mineral lubricating oils of the paraffinic, naphthenic or mixed paraffinic-naphthenic types and oils derived from coal or shale or mixtures thereof. Synthetic lubricating oils are useful and include hydrocarbon oils such as polymerised and interpolymerised olefins (e.g., polybutylenes, poly-propylenes, propyleneisobutylene copolymers); poly(1-hexenes), poly(1-octenes), poly(1-decenes), and mixtures thereof; alkyl-benzenes (e.g., dodecylbenzenes, tetradecylbenzenes, dinonylbenzenes, di-(2-ethylhexyl)-benzenes); polyphenyls (e.g., biphenyls, terphenyls, alkylated polyphenyls); diphenyl alkanes, alkylated diphenyl alkanes, alkylated diphenyl ethers and alkylated diphenyl sulphides and the derivatives, analogs and homologs thereof or mixtures thereof. Other synthetic lubricating oils include polyol esters (such as Priolube.RTM.3970), diesters, liquid esters of phosphorus-containing acids (e.g., tricresyl phosphate, trioctyl phosphate, and the diethyl ester of decane phosphonic acid), or polymeric tetrahydrofurans. Synthetic oils may be produced by Fischer-Tropsch reactions and typically may be hydroisomerised Fischer-Tropsch hydrocarbons or waxes. In one embodiment, oils may be prepared by a Fischer-Tropsch gas-to-liquid synthetic procedure as well as other gas-to-liquid oils.

Oils of lubricating viscosity may also be defined as specified in the American Petroleum Institute (API) Base Oil Interchangeability Guidelines. The five base oil groups are as follows: Group I (sulfur content >0.03 wt. %, and/or <90 wt. % saturates, viscosity index 80-120); Group II (sulphur content ≤0.03 wt. %, and ≥90 wt. % saturates, viscosity index 80-120); Group III (sulphur content ≤0.03 wt. %, and ≥0.90 wt. % saturates, viscosity index ≤120); Group IV (all polyalphaolefins (PAOs)); and Group V (all others not included in Groups I, II, III, or IV). The oil of lubricating viscosity comprises an API Group I, Group II, Group III, Group IV, Group V oil or mixtures thereof. Often the oil of lubricating viscosity is an API Group I, Group II, Group III, Group IV oil or mixtures thereof. Alternatively, the oil of lubricating viscosity is often an API Group II, Group III or Group IV oil or mixtures thereof. In some embodiments, the oil of lubricating viscosity used in the described lubricant compositions includes a Group III base oil.

The amount of the oil of lubricating viscosity present is typically the balance remaining after subtracting from 100 wt. % the sum of the amount of the additive(s) as described hereinbelow.

Dispersant

A primary additive contained in the lubricating oil compositions of the present technology is at least one succinimide dispersant which comprises the reaction product of:

i) a hydrocarbyl substituted acylating agent wherein the hydrocarbyl substituent has a molecular weight of about 1200 or less; and ii) at least one polyamine containing at least one sterically hindered amine moiety.

In one aspect, the hydrocarbyl substituted acylating agent is an aliphatic hydrocarbyl substituted succinic acylating agent wherein the aliphatic hydrocarbyl substituent has a number average molecular weight ($\overline{M}_n$) ranging from about 400 to about 1200, or about 500 to about 1100, or about 800 to about 1000. Particularly suitable for use as an acylating agent is i) at least one aliphatic substituted succinic acid or ii) at least one aliphatic hydrocarbyl substituted succinic anhydride or iii) a combination of at least one aliphatic substituted succinic acid and at least one aliphatic hydrocarbyl substituted succinic anhydride.

In one aspect, the aliphatic hydrocarbyl substituted acylating agent can be represented by the structure:

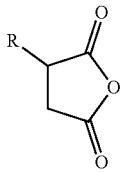

wherein R represents an aliphatic hydrocarbyl substituent having a number average molecular weight ranging from about 400 to about 1200, or about 500 to about 1100, or about 800 to about 1000. In one aspect, R has a number average molecular weight of about 1000.

In one aspect, the aliphatic hydrocarbyl substituent is derived from a polyolefin homopolymer or copolymer prepared from polymerizable olefinic monomers containing 3 to 16 carbon atoms. The copolymeric substituent contains residues from two or more olefinic monomers which are polymerized according to known procedures in the art. Accordingly, as used herein, the term "copolymer" is inclusive of copolymers, terpolymers, tetrapolymers, etc. As will be apparent to those of ordinary skill in the art, the polyalkenes from which the substituent groups are derived are often conventionally referred to as "polyolefin(s)".

The olefinic monomers from which the polyalkenes are derived are polymerizable monomers characterized by the presence of one or more ethylenically unsaturated groups (i.e., >C═C<); that is, they are mono-olefinic monomers such as ethylene, propylene, 1-butene, isobutene, and 1-octene or polyolefinic monomers (usually diolefinic monomers) such as 1,3-butadiene, and isoprene. In one aspect, polyolefins include polybutene, polypropylene, polydecene, isobutylene α-olefin copolymers, and mixtures thereof The olefin monomers are usually polymerizable terminal olefins (α-olefins). However, polymerizable internal olefin monomers (sometimes referred to in the patent literature as medial olefins) can be employed to prepare the polyalkenyl substituent. When internal olefin monomers are employed, they normally will be employed with terminal olefins to produce polyalkenes which are copolymers. In one aspect, the polyolefinic substituents are prepared from predominantly terminal olefins. In this context, "predominantly" means that at least 60 wt. %, or at least 75 wt. %, or at least 90 wt. %, or at least 95 to 100 wt. % of the olefins are terminal olefins.

In one aspect, the polyolefinic substituent is free of aromatic groups. In one aspect, the polyolefinic substituent is a homopolymer or copolymer prepared from terminal olefins of 3 to 16 carbon atoms. In one aspect, the polyolefinic substituent is a homopolymer or copolymer prepared from terminal hydrocarbon olefins of 3 to 6 carbon atoms. In one aspect, the polyolefiic substituent is a homopolymer or copolymer prepared from terminal hydrocarbon olefins of 3 to 4 carbon atoms. In one aspect, the polyolefinic copolymer substituent optionally contains up to 25 wt. %, or up to 40 wt. % of repeating units derived from internal olefins of up to 16 carbon atoms.

Specific non-limiting examples of terminal and internal olefin monomers which can be used to prepare the polyalkenyl substituents according to conventional, well-known polymerization techniques include ethylene, propylene, 1-butene, 2-butene; isobutene, 1-pentene, 1-hexene, 1-heptene; 1-octene, 1-nonene, 1-decene, 2-pentene, propylene-tetramer, diisobutylene, isobutylene trimer, 1,2-butadiene, 1,3-butadiene, 1,2-pentadiene, 1,3-pentadiene, 1,4-pentadiene, isoprene, 1,5-hexadiene, 2-methyl-1-heptene, 3-cyclohexyl-1-butene, 2-methyl-5-propyl-1-hexene, 3-pentene, 4-octene, 3,3-dimethyl-1-pentene, and combinations thereof.

Specific non-limiting examples of polyolefinic substituents include polypropylenes, polybutenes, isobutene-1,3-butadiene copolymers, propene-isoprene copolymers, copolymers of 1-hexene with 1,3-hexadiene, copolymers of 1-octene with 1-hexene, copolymers of 1-heptene with 1-pentene, copolymers of 3-methyl-1-butene with 1-octene, and copolymers of 3,3-dimethyl-1-pentene with 1-hexene. In one aspect, specific examples of such copolymer substituents include a terpolymer of 95 wt. % of isobutene with 2 wt. % of 1-butene and 3 wt. % of 1-hexene, a terpolymer of 60 wt. % of isobutene with 20 wt. % of 1-pentene and 20 wt. % of 1-octene, a copolymer of 80 wt. % of 1-hexene and 20 wt. % of 1-heptene-1, and a terpolymer of 90 wt. % of isobutene with 2 wt. % of cyclohexene and 8 wt. % of propylene.

In one aspect, when the olefin copolymer includes ethylene residues, the ethylene content is preferably in the range of 20 to 80 percent by weight, or 30 to 70 percent by weight. When propylene and/or 1-butene are employed as comonomer(s) with ethylene, the ethylene content of such copolymers can range from about 45 to about 65 wt. %, although higher or lower ethylene contents may be present.

In one aspect, the polyolefin is polyisobutylene (PIB) formed by polymerizing the $C_4$-raffinate of a catalytic cracker or an ethylene plant butane/butene stream using aluminum trichloride or other acidic catalyst systems.

A polyolefin made using aluminum trichloride in the foregoing manner is termed a conventional PIB and is characterized by having unsaturated end groups shown in Table 1 with estimates of their mole percents based on moles of polyisobutylenes. The structures are as shown in EPO 0 355 895. Conventional PIBs are available commercially under numerous trade names including Lubrizol® 3104 from The Lubrizol Corporation.

TABLE 1

| PIB Terminal Group | Wt.% in Conventional PIB | Wt.% in High Vinylidene PIB |
|---|---|---|
| 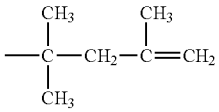 | 4-5 | 50-90% |
| 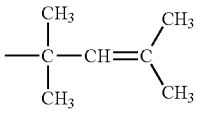 II | 0-2 | 6-35 |
| 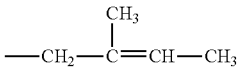 III | 63-67 tri-substituted | 0-5r |

TABLE 1-continued

| PIB Terminal Group | Wt.% in Conventional PIB | Wt.% in High Vinylidene PIB |
|---|---|---|
| 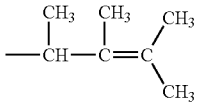 IV | 22-28 tetra-substituted | 1-15 |
| 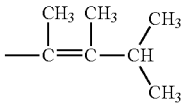 Iva | | |
| 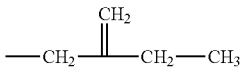 V | 5-8% | 0-4% |
| OTHER | 0-10% | None |

In one aspect, the polyolefin substituent can be a high vinylidene polyolefin, such as a high vinylidene PIB. As shown in Table 1, a high vinylidene PIB can be characterized as having a major amount, typically more than 50 mole % of an alpha-vinylidene, often referred to as methylvinylidene, and/or beta-double bond isomer (respectively, $—CH_2C(CH_3)=CH_2$ and/or $—CH=C(CH_3)_2$), and minor amounts of other isomers including a tetrasubstituted double bond isomer. High vinylidene PIBs generally can contain greater than about 50 mole %, 60 mole %, or 70 mole % or greater and usually about 80 mole % or greater or 90 mole % or greater of alpha-vinylidene and/or beta-double bond isomer and about 1 to 10 mole % of tetrasubstituted double bond isomer. In one aspect, the high vinylidene PIB has an alpha- and/or beta-vinylidene double bond isomer content of 55 mole % or greater, and in other aspects has an alpha-vinylidene and/or beta-double bond isomer content of 65, of 75, or of 85 mole % or greater. High vinylidene PIBs are prepared by polymerizing isobutylene or an isobutylene containing composition with a polymerization catalyst such as $BF_3$. High vinylidene PIBs are available commercially from several producers including BASF and Texas Petroleum Chemicals.

Polyolefin acylating agents can be prepared by reacting the polyolefin and acylating agent in a thermal process or a chlorine process. A discussion of thermal process and chlorine process can be found, for example, in paragraphs [0013] to [0017] of WO 2005/012468, published Feb. 10, 2005 to Eveland et al. As discussed in the WO '468 publication, further reference can be made to U.S. Pat. Nos. 6,165,235; 4,152,499 and 5,275,747 for information relating to polyolefin acylating agents.

The amounts of reactants in either process can range from about 0.5 or from about 0.6 moles acylating agent per mole of polyolefin up to 3 moles acylating agent per mole of polyolefin. In one aspect, from about 0.8 moles of acylating can be used per mole of polyolefin to about 1.2 moles acylating agent per mole of polyolefin, or from about 0.95 moles acylating agent per mole of polyolefin to about 1.05 moles acylating agent per mole of polyolefin. In another aspect, more than 1.5 moles of acylating agent, or from about 1.6 to 3 moles, are used per mole of polyolefin. In this aspect, from about 1.8 to about 2.5 moles acylating agent are used per mole of polyolefin, or from about 1.9 to about 2.1 moles acylating agent per mole of polyolefin.

In aspects where the polyolefin is a high vinylidene polyolefin, the polyolefin can have an average of between about 1.0 and 2.0 acylating agent moieties per polymer. For example, the polyolefin acylating agent may be a high vinylidene poly(isobutylene) succinic anhydride (PIBSA) wherein the PIB from which the PIBSA is derived contains at least 50 mole % methylvinylidene terminated molecules.

To prepare the succinimide dispersant composition of the disclosed technology, the polyolefin substituted acylating agent is reacted with a polyamine containing at least one sterically hindered amine group. In one aspect, the polyamine contains a primary amino group for reaction with the acylating agent and at least one additional sterically hindered amine. In one aspect, the polyamine contains a terminal primary amine moiety that reacts with the polyolefin substituted acylating agent and at least one sterically hindered amine, one of which is a terminal head group. By terminal head group is meant is that a sterically hindered amine moiety is situated at a position that is distal to the primary amine moiety (i.e., situated at the distal terminus of the polyamine).

In one aspect, the sterically hindered polyamine reactant conforms to the formula:

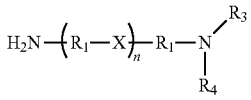

wherein $R_1$ independently is a linear or branched hydrocarbylene moiety containing 2 to 10 carbon atoms (preferably 2 to 6); X is O or $N(R_2)$, where $R_2$ is independently selected from hydrogen, substituted and unsubstituted hydrocarbyl group ($C_1$ to $C_{10}$ alkyl, $C_1$ to $C_{10}$ hydroxy substituted alkyl); n is 0 or 1 to 10; $R_3$ and $R_4$ independently represent a substituted or unsubstituted hydrocarbyl group (can be alicyclic and aromatic) containing 5 to 30 carbon atoms, subject to the proviso that the total number of carbon atoms contained in $R_3$ and $R_4$ is at least 10; $R_3$ and $R_4$ taken together with the nitrogen atom to which they are attached represents a substituted or unsubstituted monocyclic or multicyclic ring structure (non-aromatic or aromatic) containing at least 4 carbon atoms, wherein said ring structures optionally contain at least one additional heteroatom (e.g., selected from O, N, S and carbonyl) for purposes herein carbonyl will be defined as a heteroatom), subject to the proviso that when $R_2$ and $R_3$ are taken together with the nitrogen atom to which they are attached represent a monocyclic ring containing 4 or 5 carbon atoms, the two carbon atoms directly attached to said nitrogen atom are substituted with a hydrocarbyl moiety containing 1 to 5 carbon atoms.

In one aspect, $R_1$ is a hydrocarbylene moiety selected from a substituted and unsubstituted divalent alkylene radical containing 2 to 10 carbon atoms. In one aspect, $R_1$ is a divalent radical selected from ethylene, propylene, isopropylene, butylene, isobutylene, pentylene, hexylene and decylene. In one aspect, $R_1$ is substituted with a radical selected from $C_1$-$C_{10}$ alkyl, $C_1$-$C_{10}$ hydroxy substituted alkyl, and $C_1$-$C_{10}$ amino substituted alkyl, wherein the amino substituent is a sterically hindered amino group represented by

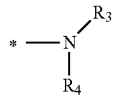

where $R_3$ and $R_4$ are defined below, and the line noted with the asterisk symbol represents a covalent bond to the polyamine compound.

In one aspect, $R_1$ is a hydrocarbylene moiety selected from a substituted and unsubstituted divalent alkylene radical containing 2 to 10 carbon atoms. In one aspect, $R_1$ is a divalent radical selected from ethylene, propylene, isopropylene, butylene, isobutylene, pentylene, hexylene and decylene. In one aspect, $R_1$ is substituted with a radical selected from $C_1$-$C_{10}$ alkyl, $C_1$-$C_{10}$ hydroxy substituted alkyl, and $C_1$-$C_{10}$ amino substituted alkyl, wherein the amino substituent is a sterically hindered amino group represented by —$N(R_3)(R_4)$, where $R_3$ and $R_4$ are defined below.

In one aspect, $R_3$ and $R_4$ independently represent a linear or branched $C_5$-$C_{24}$ alkyl radical, a substituted and unsubstituted, saturated carbocyclic radical containing 5 to 10 carbon atoms; substituted and unsubstituted aryl radical containing 6 to 14 carbon atoms, and a substituted and unsubstituted aralkyl radical containing 7 to 15 carbon atoms, wherein said substituents are selected from $C_1$-$C_5$ alkyl and $C_1$-$C_5$ hydroxyalkyl. Representative saturated carbocyclic groups include cyclopentyl, cyclohexyl, cycloheptyl and cyclooctyl. Representative aryl groups are substituted and unsubstituted phenyl, toluenyl, xylenyl naphthyl, and anthryl. Representative aralkyl groups include substituted and unsubstituted benzyl and phenylethyl.

In one aspect, $R_3$ and $R_4$ are independently selected from neopentyl, 2-ethylhexyl, 2-propylheptyl, neodecyl, lauryl, myristyl, stearyl, iso-stearyl, hydrogenated coco, hydrogenated soya, and hydrogenated tallow.

In one aspect, illustrative but non-limiting examples of the sterically hindered amine head group is represented by the following moieties:

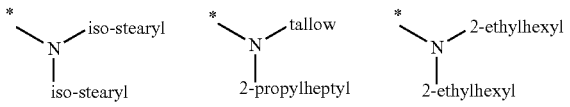

In one aspect, $R_3$ and $R_4$ taken together with the nitrogen atom to which they are attached represents a substituted or unsubstituted monocyclic or multicyclic ring structure (which can be non-aromatic or aromatic) containing at least 4 carbon atoms, wherein said ring structures optionally contain at least one additional heteroatom. In one aspect, the heteroatom is selected from O, N, S and carbonyl (for purposes herein carbonyl will be defined as a heteroatom), and the line noted with the asterisk symbol represents a covalent bond to the polyamine compound. When $R_3$ and $R_4$ are taken together with the nitrogen atom to which they are attached represent a monocyclic ring containing 4 or 5 carbon atoms, the two atoms that are directly adjacent to the nitrogen atom are carbon atoms and at least one of which is substituted with a hydrocarbyl moiety containing 1 to 5 carbon atoms. In one aspect, said substituents are selected from methyl, ethyl, propyl, isopropyl, butyl, isobutyl, tert-butyl, pentyl, neopentyl, 2-ethylhexyl, and 2-propylheptyl. In one aspect, illustrative but non-limiting examples of sterically hindered head groups where $R_3$ and $R_4$ are taken together with the nitrogen atom to which they are attached to form a carbocyclic or aromatic ring are represented by A' and B' respectively:

A'

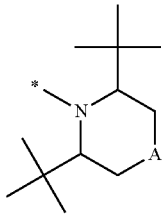

B'

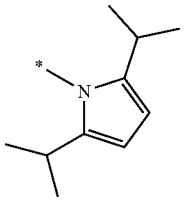

where A is selected from a carbon atom, N, O, or S, and the line noted with the asterisk symbol represents a covalent bond to the polyamine compound.

In one aspect, the polyamine reactant is represented by the formula:

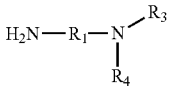

where $R_1$ is a linear or branched, substituted and unsubstituted divalent alkenyl group containing 2 to 10 carbon atoms. In one aspect $R_1$ is substituted with a radical selected from $C_1$-$C_{10}$ alkyl, $C_1$-$C_{10}$ hydroxy substituted alkyl, substituted alkyl, and $C_1$-$C_{10}$ amino substituted alkyl, wherein the amino substituent is a sterically hindered amino group represented by and $C_1$-$C_{10}$ amino substituted alkyl, wherein the amino substituent is a sterically hindered amino group represented by —$N(R_3)(R_4)$, wherein $R_3$ and $R_4$ are independently selected from selected from neopentyl, 2-ethylhexyl, 2-propylheptyl, neodecyl, lauryl, myristyl, stearyl, isostearyl, hydrogenated coco, hydrogenated soya, and hydrogenated tallow.

To prepare the succinimide dispersant of the present technology, one or more of the polyolefin acylating agents (e.g., PIB- and/or hvPIB-substituted succinic anhydride) and one or more of the polyamines of the disclosed technology are heated, typically with removal of water, optionally in the presence of a normally liquid, substantially inert organic liquid solvent/diluent at an elevated temperature, generally in the range of 80° C. up to the decomposition point of the mixture or the product; typically 100° C. to 300° C.

In one aspect, the polyamine is readily reacted with the polyolefin acylating agent by heating an oil solution containing 5 to 95 wt. % of polyolefin substituted acylating agent to about 100 to about 200° C., or about 125° to about 175° C., generally for 1 to 10, or about 2 to about 6 hours until the desired amount of water is removed. The heating is carried out to favor formation of imides rather than am ides.

In one aspect, the polyolefin substituted acylating agent can be reacted with the polyamine in a ratio of from about 4:1 to about 1:4, or from about 2:1 to 1:2, or from about 1.1:1 to about 1:1.1 on a basis of moles of polyolefin substituted acylating agent to polyamine. Additional details and examples of the procedures for preparing the succinimide dispersants of the present technology are included in, for example, U.S. Pat. Nos. 3,172,892; 3,219,666; 3,272,746; 4,234,435; 6,440,905 and 6,165,235, which are herein incorporated by reference.

In one aspect, the dispersant composition comprises a compound represented by the following structure:

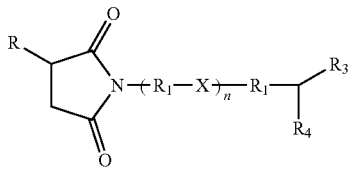

where R, $R_1$, $R_3$, $R_4$, X and n are as defined previously.

In one aspect, the dispersant composition of the disclosed technology described herein may be added to the oil of lubricating viscosity in a range of from about 0.01 wt. % to about 20 wt. %, or from about 0.05 wt. % to about 10 wt. %, or from about 0.08 wt. % to about 5 wt. %, or from about 0.1 wt. % to about 3 wt. %, or from about 0.3 wt. % to about 2 wt. %, based on the total weight of the lubricating composition.

Performance Additives

In addition to the disclosed dispersants, the lubricating oil composition can optionally comprise other performance additives as well. The other performance additives can comprise at least one of metal deactivators, dispersants, viscosity modifiers, friction modifiers, antiwear agents, corrosion inhibitors, dispersant viscosity modifiers, extreme pressure agents, antiscuffing agents, antioxidants, foam inhibitors, demulsifiers, pour point depressants, seal swelling agents and mixtures thereof. Typically, fully-formulated lubricating oil will contain one or more of these performance additives.

These additional performance additives may be present in the overall lubricant composition from 0 or 0.1 to 30 wt. %, or from 1 to 20 wt. %, or from 5 to 20 wt. %, or from 10 to 20 wt. %, or from 10 to 15 wt. %, or about 14 wt. %, based on the weight of the composition. The oil of lubricating viscosity will in some aspects make up the balance of the composition, and/or may be present from about 66 to about 99.9 wt. %, or 99.8 wt. %, or from about 78 to about 98.9 wt. %, or from about 78.5 to about 94.5 wt. %, or from about 78.9 to about 89.1 wt. %, or from about 83.9 to about 89.1 wt. %, or about 85 wt. %, based on the weight of the composition.

It is noted that the lubricant composition may be in the form of a concentrate and/or a fully formulated lubricant. For a concentrate, the relative amounts of additives would remain the same but the amount of base oil would be reduced. In such embodiments, the percent by weights of the additive may be treated as parts by weight, with the balance of the concentrate composition being made up of the desired amount of base oil.

Auxiliary Dispersant

In one aspect, an additional performance additive in the lubricant composition may further include an optional auxiliary dispersant, such as, for example, the reaction product of a PIB succinic anhydride and non-sterically hindered polyamine, such as ethylene polyamine (i.e., a poly(ethyleneamine)), a propylene polyamine, a butylene polyamine, or a mixture of two or more thereof. The aliphatic polyamine may be ethylene polyamine. The aliphatic polyamine may be selected from ethylenediamine, diethylenetriamine, triethylenetetramine, tetraethylenepentamine, pentaethylenehexamine, polyamine still bottoms, or a mixture of two or more thereof.

In one aspect, the additional additives present in the lubricant composition may further include at least one optional auxiliary PIB succinimide dispersant derived from PIB with number average molecular weight in the range 350 to 5000, or 500 to 3000. The PIB succinimide may be used alone or in combination with other dispersants. Another class of ashless dispersant is Mannich bases. Mannich dispersants are the reaction products of alkyl phenols with aldehydes (especially formaldehyde) and amines (especially polyalkylene polyamines). The alkyl group typically contains at least 30 carbon atoms.

Any of the described dispersants may also be post-treated by conventional methods by a reaction with any of a variety of agents. Among these are boron, urea, thiourea, dimercaptothiadiazoles, carbon disulfide, aldehydes, ketones, carboxylic acids, hydrocarbon-substituted succinic anhydrides, maleic anhydride, nitriles, epoxides, phosphorus compounds and/or metal compounds.

The optional auxiliary dispersant can also be a polymeric dispersant. Polymeric dispersants are interpolymers of oil-solubilizing monomers such as decyl methacrylate, vinyl decyl ether and high molecular weight olefins with monomers containing polar substituents, e.g., aminoalkyl acrylates or acrylamides and poly-(oxyethylene)-substituted acrylates.

The optional auxiliary dispersant described above may be present at 0 to about 4 wt. %, or from about 0.75 to 2.5 wt. %, based on the weight of the composition.

Detergent

In one aspect, the additional additive present in the lubricant composition may further include conventional detergents (detergents prepared by processes known in the art). Most conventional detergents used in the field of engine lubrication obtain most or all of their basicity or total base number ("TBN") from the presence of basic metal-containing compounds (metal hydroxides, oxides, or carbonates, typically based on such metals as calcium, magnesium, zinc, or sodium). Such metallic overbased detergents, also referred to as overbased or superbased salts, are generally single phase, homogeneous Newtonian systems characterized by a metal content in excess of that which would be present for neutralization according to the stoichiometry of the metal and the particular acidic organic compound reacted with the metal. The overbased materials are typically prepared by reacting an acidic material (typically an inorganic acid or lower carboxylic acid such as carbon dioxide) with a mixture of an acidic organic compound (also referred to as a substrate), a stoichiometric excess of a metal base, typically in a reaction medium of an inert, organic solvent (e.g., mineral oil, naphtha, toluene, xylene) for the acidic organic substrate. Typically, a small amount of promoter such as a phenol or alcohol is also present, and in some cases a small amount of water. The acidic organic substrate will normally have a sufficient number of carbon atoms to provide a degree of solubility in oil.

The overbased metal-containing detergent may be selected from non-sulfur containing phenates, sulfur containing phenates, sulfonates, salixarates, salicylates, and mixtures thereof, or borated equivalents thereof. The overbased detergent may be borated with a borating agent such as boric acid.

Overbased detergents are known in the art. In one aspect, the sulfonate detergent may be a predominantly linear alkylbenzene sulfonate detergent having a metal ratio of at least 8 as is described in paragraphs [0026] to [0037] of U.S. Patent Application Publication No. 2005/065045. The term "metal ratio" is the ratio of the total equivalents of the metal to the equivalents of the acidic organic compound. A neutral metal salt has a metal ratio of one. A salt having 4.5 times as much metal as present in a normal salt will have metal excess of 3.5 equivalents, or a ratio of 4.5.

In one aspect, the overbased metal-containing detergent is calcium or magnesium overbased detergent. In one embodiment, the lubricating composition comprises an overbased calcium sulfonate, an overbased calcium phenate, or mixtures thereof. The overbased detergent may comprise calcium sulfonate with a metal ratio of at least 3.

The overbased detergent may be present in an amount from about 0.05 to about 5 wt. % of the lubricating composition of the disclosed technology. In other aspects, the overbased detergent may be present at about 0.1 wt. %, or about 0.3 wt. %, or from about 0.5 to about 3.2 wt. %, or about 0.9 wt. %, or about 1.7 wt. %, based on the weight of the composition. Similarly, the overbased detergent may be present in an amount suitable to provide from 1 TBN to 10 TBN to the lubricating composition. In other embodiments, the overbased detergent is present in amount which provides from 1.5 TBN or 2 TBN up to 3 TBN, 5 TBN, or 7 TBN to the lubricating composition. TBN is a measure of the reserve of basicity of a lubricant by potentiometric titration. Commonly used methods are ASTM D4739 and ASTM D2896.

Ashless Antioxidant

The present technology provides a lubricating composition which comprises an ashless antioxidant. Ashless antioxidants may comprise one or more of arylamines, diarylamines, alkylated arylamines, alkylated diaryl amines, phenols, hindered phenols, sulfurized olefins, or mixtures thereof. In one aspect, the lubricating composition includes an antioxidant, or mixtures thereof. The antioxidant may be present from about 1.2 to about 7 wt. %, or about 1.3 to about 6 wt. %, or about 1.5 to about 5 wt. %, based on the weight of the lubricating composition.

The diarylamine or alkylated diarylamine may be a phenyl-α-naphthylamine (PANA), an alkylated diphenylamine, or an alkylated phenylnapthylamine, or mixtures thereof. The alkylated diphenylamine may include di-nonylated diphenylamine, nonyl diphenylamine, octyl diphenylamine, di-octylated diphenylamine, di-decylated diphenylamine, decyl diphenylamine and mixtures thereof. In one embodiment, the diphenylamine may include nonyl diphenylamine, dinonyl diphenylamine, octyl diphenylamine, dioctyl diphenylamine, or mixtures thereof. In one aspect, the alkylated diphenylamine may include nonyl diphenylamine or dinonyl diphenylamine. The alkylated diarylamine may include octyl, di-octyl, nonyl, di-nonyl, decyl or di-decyl phenylnapthylamines.

The diarylamine antioxidant of the present technology may be present from about 0.1 to about 10 wt. %, or about 0.35 to about 5 wt. %, or about 0.5 to about 2 wt. %, based on the weight of the lubricating composition.

The phenolic antioxidant may be a simple alkyl phenol, a hindered phenol, or coupled phenolic compounds.

The hindered phenol antioxidant often contains a secondary butyl and/or a tertiary butyl group as a sterically hindering group. The phenol group may be further substituted with a hydrocarbyl group (typically linear or branched alkyl) and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, 4-dodecyl-2,6-di-tert-butylphenol, or butyl 3-(3,5-ditert-butyl-4-hydroxyphenyl)propanoate. In one aspect, the hindered phenol antioxidant may be an ester, such as, for example, $C_7$-$C_9$ branched alkyl esters of 3,5-di-tert-butyl-4-hydroxyhydrocinnamic acid available under the tradename Irganox™ L-135 from BASF.

Coupled phenols often contain two alkylphenols coupled with alkylene groups to form bisphenol compounds. Examples of suitable coupled phenol compounds include 4,4'-methylene bis-(2,6-di-tert-butyl phenol), 4-methyl-2,6-di-tert-butylphenol, 2,2'-bis-(6-t-butyl-4-heptylphenol); 4,4'-bis(2,6-di-t-butyl phenol), 2,2'-methylenebis(4-methyl-6-t-butylphenol), and 2,2'-methylene bis(4-ethyl-6-t-butylphenol).

Useful phenols also include polyhydric aromatic compounds and their derivatives. Examples of suitable polyhydric aromatic compounds include esters and amides of gallic acid, 2,5-dihydroxybenzoic acid, 2,6-dihydroxybenzoic acid, 1,4-dihydroxy-2-naphthoic acid, 3,5-dihydroxynaphthoic acid, 3,7-dihydroxy naphthoic acid, and mixtures thereof.

In one aspect, the phenolic antioxidant comprises a hindered phenol. In another aspect, the hindered phenol is derived from 2,6-di-tert-butyl phenol.

In one aspect, the lubricating composition of the present technology comprises a phenolic antioxidant in a range from about 0.01 to about 5 wt. %, or about 0.1 to about 4 wt. %, or about 0.2 to about 3 wt. %, or about 0.5 to about 2 wt. %, based on the weight of the lubricating composition.

Anti-Wear Agent

Anti-wear agents include phosphorus-containing compounds as well as phosphorus free compounds. In one aspect, the anti-wear additive of the disclosed technology comprises a phosphorus-containing compound, a phosphorus-free compound, or combinations thereof.

Phosphorus-containing anti-wear agents are well-known to one skilled in the art and includes metal dialkyl(dithio) phosphate salts, hydrocarbyl phosphites, hydrocarbyl phosphines, hydrocarbyl phosphonates, alkylphosphate esters, amine or ammonium (alkyl)phosphate salts, and combinations thereof.

In one aspect, the phosphorus-containing ant-wear agent is a metal dialkyldithiophosphate, which may include a zinc dialkyldithiophosphate. Such zinc salts are often referred to as zinc dialkyldithiophosphates (ZDDP) or simply zinc dithiophosphates (ZDP). They are well-known and readily available to those skilled in the art of lubricant formulation. Further zinc dialkyldithiophosphates may be described as primary zinc dialkyldithiophosphates or as secondary zinc dialkyldithiophosphates, depending on the structure of the alcohol used in its preparation. In some aspects, the compositions of the present technology include primary zinc dialkyldithiophosphates. In some aspects, the compositions of the present technology include secondary zinc dialkyldithiophosphates. In some aspects, the compositions of the disclosed technology include a mixture of primary and secondary zinc dialkyldithiophosphates. In some aspects, component (b) is a mixture of primary and secondary zinc dialkyldithiophosphates where the ratio of primary zinc dialkyldithiophosphates to secondary zinc dialkyldithiophosphates (on a wt./wt. basis) is at least 1:1, or at least 1:1.2, or at least 1:1.5 or 1:2, or 1:10.

Examples of suitable metal dialkyldithiophosphate include metal salts of the formula:

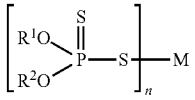

where $R^1$ and $R^2$ are independently hydrocarbyl groups containing 3 to 24 carbon atoms, or 3 to 12 carbon atoms, or 3 to 8 carbon atoms; M is a metal having a valence n and generally incudes zinc, copper, iron, cobalt, antimony, manganese, and combinations thereof. In one aspect, $R^1$ and $R^2$ are secondary aliphatic hydrocarbyl groups containing 3 to 8 carbon atoms, and M is zinc.

ZDDP may be present in the composition in an amount to deliver from about 0.01 to about 0.12 wt. % phosphorus to the lubricating composition. ZDDP may be present in an amount to deliver at least about 100 ppm, or at least about 300 ppm, or at least about 500 ppm of phosphorus to the composition up to no more than about 1200 ppm, or no more than about 1000 ppm, or no more than about 800 ppm phosphorus to the composition.

In one aspect, the phosphorus-containing anti-wear agent may be a zinc free phosphorus compound. The zinc free phosphorus anti-wear agent may contain sulfur or may be sulfur free. Sulfur free phosphorus containing anti-wear agents include hydrocarbyl phosphites, hydrocarbyl phosphines, hydrocarbyl phosphonates, alkylphosphate esters, amine or ammonium phosphate salts, or mixtures thereof.

In one aspect, the anti-wear agent may be a phosphorus free compound. Examples of suitable phosphorus free anti-wear agents include titanium compounds, hydroxy-carboxylic acid derivatives such as esters, amides, imides or amine or ammonium salt, sulfurized olefins, (thio)carbamate containing compounds, such as (thio)carbamate esters, (thio) carbamate amides, (thio)carbamic ethers, alkylene-coupled (thio)carbamates, and bis(S-alkyl(dithio)carbamyl) disulfides. Suitable hydroxy-carboxylic acid derivatives include tartaric acid derivatives, malic acid derivatives, citric acid derivatives, glycolic acid derivatives, lactic acid derivatives, and mandelic acid derivatives.

The anti-wear agent, be it phosphorus-containing, phosphorus free, or mixtures, may be present from about 0.15 to about 6 wt. %, or about 0.2 to about 3 wt. %, or from about 0.5 to about 1.5 wt. %, based on the weight of the lubricating composition.

Additional Additives

As mentioned previously, the additional additives present in the lubricant composition of the disclosed technology may further include one or more additional performance additives as well. The other performance additives can include at least one of metal deactivators, viscosity modifiers, friction modifiers, antiwear agents, corrosion inhibitors, dispersant viscosity modifiers, extreme pressure agents, antiscuffing agents, foam inhibitors, demulsifiers, pour point depressants, seal swelling agents and mixtures thereof. Typically, fully-formulated lubricating oil will contain one or more of these performance additives.

In some aspects, the total combined amount of these optional performance additives present can range from 0 wt. %, or from about 0.01 to about 50 wt. %, or from about 0.01 to about 40 wt. %, or from about 0.01 to about 30 wt. %, or about 0.05 wt. %, or about 0.1 wt. %, or from about 0.5 wt. % to about 20 wt. %, based on the weight of the lubricating composition. In one aspect, the total combined amount of the additional performance additive compounds present on an oil free basis ranges from about 0 to about 25 wt. %, or from about 0.01 to about 20 wt. % of the composition. Although, one or more of the other performance additives may be present, it is common for the other performance additives to be present in different amounts relative to each other.

The lubricating composition of the disclosed technology may be utilized in an internal combustion engine. The internal combustion engine may or may not have an Exhaust Gas Recirculation system. In one aspect, the internal combustion engine may be a diesel fueled engine (typically a heavy duty diesel engine), a gasoline fueled engine, a natural gas fueled engine or a mixed gasoline/alcohol fueled engine. In one aspect, the internal combustion engine may be a diesel fueled engine, and in another aspect a gasoline fueled engine. In one aspect, the engine may be a spark ignited engine and in one embodiment a compression engine. The internal combustion engine may be a 2-stroke or 4-stroke engine. Suitable internal combustion engines include marine diesel engines, aviation piston engines, low-load diesel engines, and automobile and truck engines.

The lubricant composition for an internal combustion engine may be suitable for any engine lubricant irrespective of the sulfur, phosphorus or sulfated ash (ASTM D-874) content. In one aspect, the lubricating composition is an engine oil, wherein the lubricating composition is characterized as having at least one of (i) a sulfur content of about 0.5 wt. % or less, (ii) a phosphorus content of about 0.1 wt. % or less, and (iii) a sulfated ash content of about 1.5 wt. % or less. In one aspect, the lubricating composition comprises less than about 1.5 wt. % unreacted polyisobutene, or less than about 1.25 wt. %, or less than about 1 wt. %., or less than about 0.8 wt. %, or less than about 0.5 wt. %, or less than about 0.3 wt. %. In one aspect, the sulfur content may be in the range of from about 0.001 to about 0.5 wt. %, or from about 0.01 to about 0.3 wt. %, based on the weight of the composition. The phosphorus content may be about 0.2 wt. % or less, or about 0.1 wt. % or less, or about 0.085 wt. % or less, or about 0.06 wt. % or less, or about 0.055 wt. % or less, or about 0.05 wt. % or less. In one aspect, the phosphorus content may be about 100 ppm to about 1000 ppm, or about 325 ppm to about 700 ppm. The total sulfated ash content may be about 2 wt. % or less, or about 1.5 wt. % or less, or about 1.1 wt. % or less, or about 1 wt. % or less, or about 0.8 wt. % or less, or about 0.5 wt. % or less, based on the weight of the composition. In one aspect, the sulfated ash content may be from about 0.05 to about 0.9 wt. %, or about 0.1 wt. % to about 0.45 wt. %, based on the weight of the composition.

In one aspect, the lubricating composition is an engine oil, wherein the lubricating composition is characterized as having at least one of (i) a sulfur content of about 0.5 wt. % or less, (ii) a phosphorus content of about 0.1 wt. % or less, and (iii) a sulfated ash content of about 1.5 wt. % or less. In one aspect, the lubricating composition comprises less than about 1.5 wt. % unreacted polyisobutene, or less than about 1.25 wt. %, or less than about 1.0 wt. %.

In some embodiments, the lubricant composition is an engine oil composition for a turbocharged direct injection (TDI) engine.

The disclosed technology also provides a method of mitigating seals degradation in an internal combustion engine comprising: (1) supplying to the engine a lubricant composition comprising:

a) an oil of lubricating viscosity; and b) a succinimide dispersant which is the reaction product of:

i) a hydrocarbyl substituted acylating agent wherein the hydrocarbyl substituent has a molecular weight of about 1200 or less; and ii) at least one polyamine containing at least one sterically hindered amine moiety; and (2) operating the engine. In some embodiments, the engine is a turbocharged direct injection (TDI) engine.

The disclosed technology also provides for a method of reducing deposits and mitigating seals degradation in a TDI engine, and in some embodiments a method of reducing piston deposits in a TDI engine. These methods include utilizing the described lubricant composition, containing the a succinimide dispersant which is the reaction product of:

i) a hydrocarbyl substituted acylating agent wherein the hydrocarbyl substituent has a molecular weight of about 1200 or less; and ii) at least one polyamine containing at least one sterically hindered amine moiety, in the operation of the engine.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include: (i) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring); (ii) substituted hydrocarbon substituents, that is, substituents containing non-hydrocarbon groups which, in the context of the disclosed technology, do not alter the predominantly hydrocarbon nature of the substituent (e.g., halo (especially chloro and fluoro), hydroxy, alkoxy, mercapto, alkylmercapto, nitro, nitroso, and sulfoxy); (iii) hetero substituents, that is, substituents which, while having a predominantly hydrocarbon character, in the context of the disclosed technology, contain other than carbon in a ring or chain otherwise composed of carbon atoms and encompass substituents as pyridyl, furyl, thienyl and imidazolyl. Heteroatoms include sulfur, oxygen, and nitrogen. In general, no more than two, or no more than one, non-hydrocarbon substituent will be present for every ten carbon atoms in the hydrocarbyl group; alternatively, there may be no non-hydrocarbon substituents in the hydrocarbyl group.

It is known that some of the materials described above may interact in the final formulation, so that the components of the final formulation may be different from those that are initially added. For instance, metal ions (of, e.g., a detergent) can migrate to other acidic or anionic sites of other molecules. The products formed thereby, including the products formed upon employing the disclosed compositions, may not be susceptible of easy description. Nevertheless, all such modifications and reaction products are included within the scope of the present technology and the disclosed compositions encompass products formed by admixing the components and/or materials described above.

The following examples provide illustrations of the disclosed technology. These examples are non-exhaustive and are not intended to limit the scope of the present technology.

EXAMPLES

Example A (Comparative Synthesis Example)

A 2 L flange flask equipped with an overhead stirrer, Dean-Stark trap, nitrogen inlet and a thermocouple was charged with 650 g (0.98 mole) of polyisobutenyl succinic anhydride (the polyisobutenyl substituent had a $\overline{M}_n$ of 550) and 539 g of diluent oil. The nitrogen flow through the vessel was set at 1 cubic foot per hour and the reaction mixture was heated to 90° C. Once at temperature, 159 g (0.98 mole) of aminopropyl diethanolamine was added sub-surface over 1 hour. An exotherm was observed and the controlled addition of amine was conducted to maintain the reaction temperature below 120° C. After completion of the addition, the reaction mixture was heated to 150° C. and stirred at that temperature for a further 2 hours. As the reaction progressed water was produced and was removed using the Dean-Stark trap. The progress of the reaction was monitored by IR and the formation of the cyclic imide product was observed. The resultant material was cooled to 60° C. and collected to yield 1.28 kg of product. A representative product structure is set forth below:

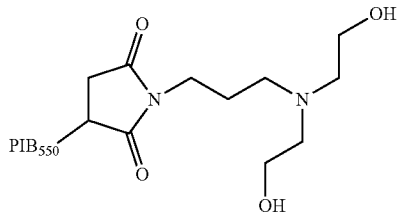

Example B (Comparative Synthesis Example)

A 2 L flange flask equipped with an overhead stirrer, Dean-Stark trap, nitrogen inlet and a thermocouple was initially charged with 701 g (1.05 moles) of polyisobutenyl succinic anhydride (the polyisobutenyl substituent had a $\overline{M}_n$ of about 1000) and 560 g of diluent oil. The nitrogen flow through the vessel was set at 1 cubic foot per hour and the reaction mixture was heated to 90° C. Once at temperature, 137 g (1.05 moles) of 3-(diethylamino)propylamine was added sub-surface over 1 hour. An exotherm was observed and the controlled addition of amine is conducted to maintain the reaction temperature below 120° C. After completion of the addition, the reaction mixture was heated to 150° C. and stirred at that temperature for a further 2 hours. As the reaction progressed, water was produced and removed using the Dean-Stark trap. The progress of the reaction was monitored by IR, and the formation of the cyclic imide product was observed. The resultant material was cooled to 60° C. and collected to yield 1.35 kg of product. A representative product structure is set forth below:

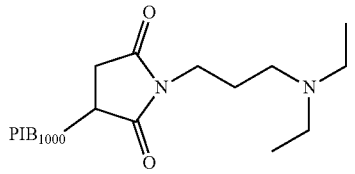

Example C (Illustrative Synthesis Example)

A 3 L flange flask equipped with an overhead stirrer, Dean-Stark trap, nitrogen inlet and a thermocouple was initially charged with 880 g (0.94 mole) of polyisobutenyl succinic anhydride (the polyisobutenyl substituent had a $\overline{M}_n$ of about 1000) and 611 g of diluent oil. The nitrogen flow through the vessel was set at 1 cubic foot per hour and the reaction mixture was heated to 90° C. Once at temperature, 546 g (0.94 mole) of N,N-diisostearyl-1,3-aminopropane (Duomeen 2-IS, AkzoNobel) was added sub-surface over 1 hour. An exotherm was observed and the controlled addition of amine was conducted to maintain the reaction temperature below 120° C. After completion of the addition, the reaction mixture was heated to 150° C. and stirred at that temperature for a further 2 hours. As the reaction progressed, water was produced and was removed using the Dean-Stark trap. The progress of the reaction is monitored by IR, and the formation of the cyclic imide product could be observed. The resultant material was cooled to 60° C. and collected to yield 1.88 kg of product. A representative product structure is set forth below:

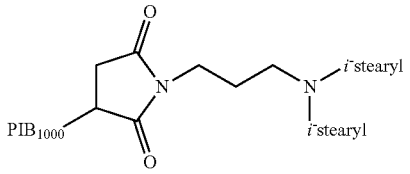

Example D (Illustrative Synthesis Example)

A 0.5 L flange flask equipped with an overhead stirrer, Dean-Stark trap, nitrogen inlet and a thermocouple was initially charged with 129 g (0.14 mole) of polyisobutenyl succinic anhydride (the polyisobutenyl substituent had a $\overline{M}_n$ of about 1000) and 83 g of diluent oil. The nitrogen flow through the vessel was set at 1 cubic foot per hour and the reaction mixture was heated to 90° C. Once at temperature, 64 g (0.14 mole) of N,N-tallow,2-propylheptyl-1,3-aminopropane (Duomeen HTL10, AkzoNobel) was added sub-surface over 1 hour. An exotherm was observed and the controlled addition of amine was conducted to maintain the reaction temperature below 120° C. After completion of the addition, the reaction mixture was heated to 150° C. and stirred at that temperature for a further 2 hours. As the reaction progressed, water was produced and was removed using the Dean-Stark trap. The progress of the reaction was monitored by IR, and formation of the cyclic imide product was observed. The resultant material was cooled to 60° C. and collected to yield 259 g of product. A representative product structure is set forth below:

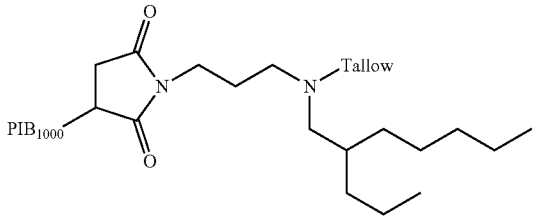

Example E (Illustrative Synthesis Example)

A 0.5 L flange flask equipped with an overhead stirrer, Dean-Stark trap, nitrogen inlet and a thermocouple was initially charged with 224 g (0.24 mole) of polyisobutenyl succinic anhydride (the polyisobutenyl substituent had a $\overline{M}_n$ of about 1000) and 74 g of diluent oil. The nitrogen flow through the vessel was set at 1 cubic foot per hour and the reaction mixture was heated to 90° C. Once at temperature, 70 g (0.24 mole) of N,N-bis-2-ethylhexyl-1,2-aminoethane was added sub-surface over 1 hour. An exotherm was observed and the controlled addition of amine is conducted to maintain the reaction temperature below 120° C. After completion of the addition, the reaction mixture was heated to 150° C. and stirred at that temperature for a further 2 hours. As the reaction progressed water was produced and was removed using the Dean-Stark trap. The progress of the reaction was monitored by IR and the formation of the cyclic imide product was observed. The resultant material was cooled to 60° C. and collected to yield 348 g of product. A representative product structure is set forth below:

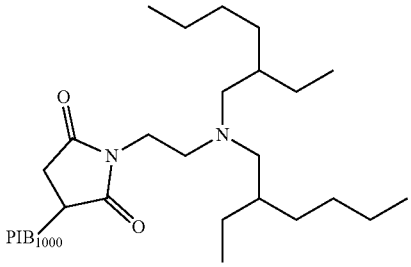

Example F (Comparative Synthesis Example)

A 2 L flange flask equipped with an overhead stirrer, Dean-Stark trap, nitrogen inlet and a thermocouple was initially charged with 800 g (0.86 mole) of polyisobutenyl succinic anhydride (the polyisobutenyl substituent had a $\overline{M}_n$ of about 1000) and 389 g of diluent oil. The nitrogen flow through the vessel was set at 1 cubic foot per hour and the reaction mixture was heated to 110° C. Once at temperature, 123 g (0.86 mole) of 3-morpholinopropylamine was added over 30 minutes. An exotherm is observed and the controlled addition of amine was conducted to maintain the reaction temperature below 120° C. After completion of the addition, the reaction mixture was heated to 150° C. and stirred at that temperature for an additional 5 hours. As the reaction progressed water was produced and was removed using the Dean-Stark trap. The progress of the reaction was monitored by IR and formation of the cyclic imide product could be observed. The resultant material was cooled, passed through a filter cloth and collected to yield 1.23 kg of product. A representative product structure is set forth below:

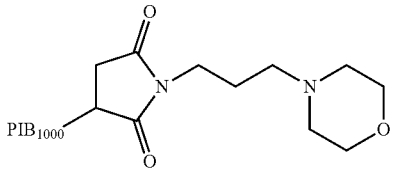

Example G (Comparative Synthesis Example)

A 3 L flange flask equipped with an overhead stirrer, Dean-Stark trap, nitrogen inlet and a thermocouple was initially charged with 1350 g (1.44 moles) of polyisobutenyl succinic anhydride (the polyisobutenyl substituent had a $\overline{M}_n$ of about 1000) and 433 g of diluent oil. The nitrogen flow through the vessel was set at 1 cubic foot per hour and the reaction mixture was heated to 90° C. Once at temperature, 269 g (1.44 mole) of 3-(dibutylamino)propylamine was added sub-surface over 1 hour. An exotherm was observed and the controlled addition of amine was conducted to maintain the reaction temperature below 120° C. After completion of the addition, the reaction mixture was heated to 150° C. and stirred at that temperature for an additional 2 hours. As the reaction progressed water was produced and was removed using the Dean-Stark trap. The progress of the reaction was monitored by IR and the formation of the cyclic imide product was observed. The resultant material was cooled to 60° C. and collected to yield 1.97 kg of product. A representative product structure is set forth below:

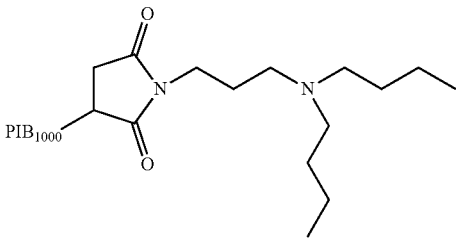

Example H (Comparative Synthesis Example)

A 1 L flange flask equipped with an overhead stirrer, Dean-Stark trap, nitrogen inlet and a thermocouple was initially charged with 490 g (0.52 mole) of polyisobutenyl succinic anhydride (the polyisobutenyl substituent had a $\overline{M}_n$ of about 1000) and 141 g of diluent oil. The nitrogen flow through the vessel was set at 1 cubic foot per hour and the reaction mixture was heated to 90° C. Once at temperature, 74 g (0.52 mole) of N-(3-Aminopropyl)-2-pyrrolidinone was added sub-surface over 1 hour. An exotherm was observed and the controlled addition of amine was conducted to maintain the reaction temperature below 120° C. After completion of the addition, the reaction mixture was heated to 150° C. and stirred at that temperature for a further 4 hours. As the reaction progressed water was produced and was removed using the Dean-Stark trap. The progress of the reaction was monitored by IR and the formation of the cyclic imide product was observed. The resultant material was cooled to 60° C. and collected to yield 0.74 kg of product. A representative product structure is set forth below:

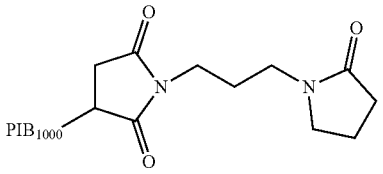

Example I (Illustrative Synthesis Example)

A 3 L flange flask equipped with an overhead stirrer, Dean-Stark trap, nitrogen inlet and a thermocouple was initially charged with 880 g (1.36 moles) of polyisobutenyl succinic anhydride (the polyisobutenyl substituent had a $\overline{M}_n$ of about 550) and 417 g of diluent oil. The nitrogen flow through the vessel was set at 1 cubic foot per hour and the reaction mixture was heated to 90° C. Once at temperature, 786 g (1.36 moles) of N,N-diisostearyl-1,3-aminopropane (Duomeen 2-IS, AkzoNobel) was added sub-surface over 1 hour. An exotherm was observed and the controlled addition of amine was conducted to maintain the reaction temperature below 120° C. After completion of the addition, the reaction mixture was heated to 150° C. and stirred at that temperature for a further 4 hours. As the reaction progressed water was produced and was removed using the Dean-Stark trap. The progress of the reaction was monitored by IR and formation of the cyclic imide product could be observed. The resultant material was cooled to 60° C. and collected to yield 2.02 kg of product. A representative product structure is set forth below:

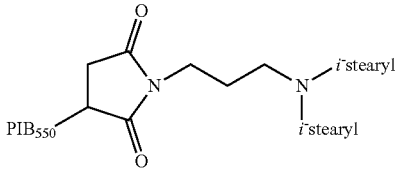

Example J (Comparative Synthesis Example)

A 3 L flange flask equipped with an overhead stirrer, Dean-Stark trap, nitrogen inlet and a thermocouple was initially charged with 1300 g (1.39 moles) of polyisobutenyl succinic anhydride (the polyisobutenyl substituent had a $\overline{M}_n$ of about 1000). The nitrogen flow through the vessel was set at 1 cubic foot per hour and the reaction mixture was heated to 90° C. Once at temperature, 181 g (1.39 moles) of N,N,2,2-tetramethyl-1,3-propanediamine was added sub-surface over 1 hour. An exotherm was observed and the controlled addition of amine was conducted to maintain the reaction temperature below 120° C. After completion of the addition, the reaction mixture was heated to 150° C. and stirred at that temperature for an additional 4 hours. As the reaction progressed water was produced was removed using the Dean-Stark trap. The progress of the reaction was monitored by IR and the formation of the cyclic imide product was observed. The resultant material was cooled to 60° C. and collected to yield 1.38 kg of product. A representative product structure is set forth below:

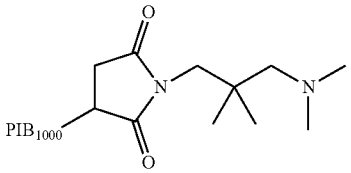

Lubricating Compositions

A series of OW-20 engine lubricants in Group III and polyalphaolefin base oils of lubricating viscosity were prepared containing the dispersant additives described above as well as conventional additives including polymeric viscosity modifiers, anti-wear agents, overbased detergents, antioxidants (combination of phenolic ester and diarylamine), as well as other performance additives as set forth in Tables 1 and 1a. The TBN of each of the examples is also presented in the table in part to show that each example had a similar level of basicity to provide a proper comparison between the comparative and technology examples.

TABLE 1

| Lubricating Oil Composition Formulations[1] | | | | | | |
|---|---|---|---|---|---|---|
| | EXAMPLE NO. | | | | | |
| | 1 | 2 | 3 | 4 | 5 | 6 |
| PAO-4 | 21.6 | 22.2 | 21.8 | 21.6 | 21.6 | 21.6 |
| Group III Base Oil | Balance to 100% | | | | | |
| Dispersant A1[2] | 4.9 | | | | | |
| Dispersant B1[3] | | 4.9 | | | | |
| Example A | | | 4.9 | | | |
| Example B | | | | 5.6 | | |
| Example C | | | | | 4.9 | |
| Example D | | | | | | 4.9 |
| Example E | | | | | | |
| Example F | | | | | | |
| Example G | | | | | | |
| Example H | | | | | | |
| Example I | | | | | | |
| Example J | | | | | | |
| Calcium Sulfonate[4] | 1.0 | 1.0 | 1.0 | 1.0 | 1.0 | 1.0 |
| Calcium Phenate[5] | 0.74 | 0.74 | 0.74 | 0.74 | 0.74 | 0.74 |
| ZDDP[6] | 0.8 | 0.8 | 0.8 | 0.8 | 0.8 | 0.8 |
| AO[7] | 1.8 | 1.8 | 1.8 | 1.8 | 1.8 | 1.8 |
| VI Improver[8] | 0.06 | 0.06 | 0.06 | 0.06 | 0.06 | 0.06 |
| Other Additives[9] | 0.51 | 0.51 | 0.51 | 0.51 | 0.51 | 0.51 |
| TBN (ASTM D2896) | 10.5 | 13.1 | not run | not run | 12.3 | 12.3 |

TABLE 1a

| Lubricating Oil Composition Formuations[1] | | | | | | |
|---|---|---|---|---|---|---|
| | EXAMPLE NO. | | | | | |
| | 7 | 8 | 9 | 10 | 11 | 12 |
| PAO (4 cSt) | 21.6 | 21.8 | 21.6 | 21.6 | 21.8 | 21.8 |
| Group III Base Oil | Balance to 100% | | | | | |
| Dispersant A1[2] | | | | | | |
| Dispersant B1[3] | | | | | | |
| Example A | | | | | | |
| Example B | | | | | | |
| Example C | | | | | | |
| Example D | | | | | | |
| Example E | 4.9 | | | | | |
| Example F | | 4.9 | | | | |
| Example G | | | 4.9 | | | |
| Example H | | | | 4.9 | | |
| Example I | | | | | 4.9 | |
| Example J | | | | | | 4.9 |
| Calcium Sulfonate[4] | 1.0 | 1.0 | 1.0 | 1.0 | 1.0 | 1.0 |
| Calcium Phenate[5] | 0.74 | 0.74 | 0.74 | 0.74 | 0.74 | 0.74 |
| ZDDP[6] | 0.8 | 0.8 | 0.8 | 0.8 | 0.8 | 0.8 |
| AO[7] | 1.8 | 1.8 | 1.8 | 1.8 | 1.8 | 1.8 |
| VI Improver[8] | 0.06 | 0.06 | 0.06 | 0.06 | 0.06 | 0.06 |
| Other Additives[9] | 0.51 | 0.51 | 0.51 | 0.51 | 0.51 | 0.51 |
| TBN (ASTM D2896) | 13.0 | not run | 13.1 | not run | not run | not run |

[1]Treat rates are on an active (oil free) basis unless otherwise noted

[2]PIBsuccinimide dispersant derived from 1600 Mn PIB, functionalized with triethylenetetramine (TBN 17 mg KOH/g)

[3]PIBsuccinimide dispersant derived from 980 Mn PIB, functionalized with (N,N-dimethyl) amino-propylamine (DMAPA) (TBN 54.5 mg KOH/g)

[4]Overbased calcium alkylbenzene sulfonate; TBN 515 mg KOH/g

[5]Overbased calcium sulfurized phenate; TBN 400 mg KOH/g

[6]Mixture of C3 and C6 secondary zinc dialkyldithiophosphate

[7]Mixture of alkylated diphenylamine and hindered phenol antioxidants

[8]Styrene butadiene block copolymer

[9]Other additives include friction modifier, corrosion inhibitor, foam inhibitor, and pour point depressant Testing The dispersants (and hence the lubricating compositions) of the present technology are designed to provide, deposit control (cleanliness), while minimizing the contribution to low temperature viscosity, all while providing adequate corrosion control and seals compatibility.

The viscosity profiles of the lubricating compositions were determined utilizing a high temperature high shear (HTHS) viscosity test and a cold crank simulator (CCS) test. HTHS viscosity is determined in accordance with ASTM D4683 at 150° C. and $1.0 \cdot 10^6$ $s^{-1}$ using a tapered bearing simulator (TBS) viscometer. Low temperature flow to an engine oil pump or oil distribution system is simulated in the CCS test by measuring the engine starting viscosity of the oil at −35° C. in accordance with ASTM D5293.

Deposit control was determined by a micro-coker test (MCT) as per Le Groupement Français de Coordination (GFC) test method Lu-27-A-13 Issue 2c. The MCT evaluates the tendency of a lubricant to form carbon deposits or residue as the lubricant evaporates or thermally degrades. A sample of the oil was placed on a metal plate. Different spots on the metal plate were heated to 280° C. ("hot temperature") and 230° C. ("cold temperature"), respectively. The metal plate was then visually inspected for carbon deposits or residue and compared to a standard. A merit rating with a value ranging from 1 to 10 was assigned to each sample, with 1 having the most residue and 10 having the least amount of residue. A higher merit rating is indicative of better deposit control performance.

Corrosion was evaluated in the high temperature corrosion bench test (HTCBT) per ASTM procedure D6594. The amount of copper (Cu) and lead (Pb) in the evaluated oils at the end of the test was measured and compared to the amount at the beginning of the test. Lower copper and lead content in the oil indicated decreased copper and lead corrosion. Additionally, a visual copper rating (1-4) was conducted pursuant to the copper strip classifications set forth in ASTM D130. Lower visual rating numbers are indicative of less tarnish (corrosion).

Seals compatibility was evaluated in accordance to the specification laid out in VW PV3344 by suspending a fluorocarbon elastomer test specimen within the lubricant at 150° C. for 168 hours. On termination of the specimen immersion treatment, the change in mechanical properties was evaluated. The average of the tensile strength (T/S) break across several runs in accordance with procedure DIN 53504 was recorded. The pass criteria included no evidence of cracking and a tensile strength break of ≥7 $N/mm^2$. The results of all tests described above are summarized in Table 2.

TABLE 2

| Deposit Control and Corrosion Testing | | | | | | | | | | | | |
|---|---|---|---|---|---|---|---|---|---|---|---|---|
| | EXAMPLE NO. | | | | | | | | | | | |
| | 1 | 2 | 3 | 4 | 5 | 6 | 7 | 8 | 9 | 10 | 11 | 12 |
| HTHS (cP) | 2.69 | 2.37 | 2.46 | 2.42 | 2.40 | 2.39 | 2.36 | 2.41 | 2.38 | 2.38 | 2.27 | 2.35 |
| CCS (cP) | 5680 | 5030 | 5150 | 5270 | 4740 | 4680 | 4840 | 5080 | 4850 | 5280 | 4390 | 4660 |
| MCT | | | | | | | | | | | | |
| Merit Rating | 8.1 | 8.1 | 6.6 | 6.9 | 7.2 | 7.4 | 8.0 | 7.0 | 7.5 | 8.0 | 7.1 | 7.5 |
| HTCBT | | | | | | | | | | | | |
| ΔCu (ppm) | 5 | 7 | 44 | 11 | 5 | 6 | 3 | 4 | 7 | 12 | not run | 5 |
| Cu Visual Rating | 1a | 1a | 3b | 1b | 1a | 1a | 1a | 1a | 1a | 3b | not nun | 1A |
| ΔPb (ppm) | 13 | 79 | 448 | 126 | 15 | 11 | 4 | 9 | 36 | 61 | not run | 18 |
| Seals | | | | | | | | | | | | |
| Avg. T/S % (168 h) | pass | fail | 4.66 | 3.98 | 7.66 | 7.96 | 7.42 | 5.84 | 3.48 | 5.94 | 7.00 | 3.3 |

The data indicates that low molecular weight (i.e., thin) dispersants provide adequate deposit control with improved low temperature viscosity. However, only the sterically hindered tertiary amine containing dispersants of the disclosed technology are able to pass critical fluorocarbon elastomer seals compatibility tests as well as provide acceptable corrosion resistance.

What is claimed is:

1. A lubricating composition suitable for reducing engine sludge and degradation of elastomeric seals comprising:

a) an oil of lubricating viscosity; and b) a hydrocarbyl substituted succinimide dispersant comprising the reaction product of:

(i) a hydrocarbyl substituted succinic anhydride; and (ii) a hindered polyamine of the structure:

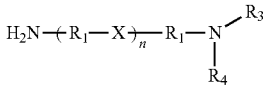

wherein $R_1$ independently is a linear or branched hydrocarbylene moiety containing 2 to 10 carbon atoms; X is O; n is 0 or 1 to 10; $R_3$ and $R_4$ independently represent neopentyl, 2-ethylhexyl, 2-propylheptyl, neodecyl, lauryl, myristyl, stearyl, isostearyl, hydrogenated coco, hydrogenated soya, and hydrogenated tallow.

2. A lubricating composition of claim 1, wherein said hydrocarbyl substituted succinic anhydride reactant (i) is represented by the structure:

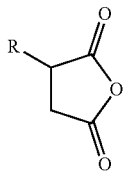

wherein R is a hydrocarbyl group having a molecular wt. ranging from about 400 to about 1200 $\overline{M}_n$.

3. A lubricating composition of claim 1, wherein said hydrocarbyl group on said hydrocarbyl substituted succinic anhydride reactant is an alkenyl radical obtained from polymerizing an olefin containing 2 to 5 carbon atoms.

4. A lubricating composition of claim 1, wherein said hydrocarbyl group on said hydrocarbyl substituted succinic anhydride reactant (i) is a polyisobutylene substituent.

5. A lubricating composition of claim 1, wherein $R_1$ situated on said dispersant is a divalent alkylene radical.

6. A lubricating composition of claim 5, wherein $R_1$ is a divalent radical selected from ethylene, propylene, isopropylene, butylene, isobutylene, pentylene, and hexylene.

7. A lubricating composition of claim 1, wherein $R_1$ is substituted with a substituent selected from $C_1$-$C_{10}$ alkyl and $C_1$-$C_{10}$ hydroxy substituted alkyl.

8. The lubricating composition of claim 1, wherein the oil of lubricating viscosity comprises a mineral oil, a synthetic oil, or a combination thereof.

9. The lubricant composition of claim 1, wherein the lubricant composition further comprises (iii) an additive package, where the additive package comprises one or more auxiliary dispersants, viscosity modifiers, pour point depressants, antioxidants, friction modifiers, detergents, antiwear agents, corrosion inhibitors, antifoam agents, diluent oil, or any combination thereof.

10. A method of improving deposit performance in an engine comprising adding to the engine a composition of claim 1.

11. A method of improving seal performance in an engine comprising applying to the engine a composition of claim 1.

12. The method of reducing deposits and corrosion on the internal parts of an internal combustion engine and mitigate seals degradation comprising adding the composition of claim 1 to the engine and operating said engine.

* * * * *